US010758774B2

(12) United States Patent
Tholkes et al.

(10) Patent No.: US 10,758,774 B2
(45) Date of Patent: Sep. 1, 2020

(54) WALK THERAPY STATION

(71) Applicant: ALT Innovations LLC, Prior Lake, MN (US)

(72) Inventors: Alan Tholkes, Prior Lake, MN (US); DuWayne Dandurand, Jordan, MN (US); Nathaniel Hallée, Eden Prairie, MN (US)

(73) Assignee: ALT INNOVATIONS LLC, Prior Lake, MN (US)

( * ) Notice: Subject to any disclaimer, the term of this patent is extended or adjusted under 35 U.S.C. 154(b) by 130 days.

(21) Appl. No.: 16/153,393

(22) Filed: Oct. 5, 2018

(65) Prior Publication Data

US 2019/0105530 A1 Apr. 11, 2019

Related U.S. Application Data

(60) Provisional application No. 62/569,378, filed on Oct. 6, 2017.

(51) Int. Cl.
*A63B 22/00* (2006.01)
*A63B 21/00* (2006.01)

(52) U.S. Cl.
CPC ..... *A63B 22/0056* (2013.01); *A63B 21/4034* (2015.10); *A63B 22/001* (2013.01); (Continued)

(58) Field of Classification Search
CPC ..... A63B 22/001; A63B 22/0056; A63B 22/06–0694; A61H 1/0262; A61H 2001/0211
See application file for complete search history.

(56) References Cited

U.S. PATENT DOCUMENTS 7,163,492 B1 1/2007 Sotiriades
7,833,134 B2 11/2010 Gordon
(Continued)

FOREIGN PATENT DOCUMENTS

WO 2015088668 6/2015
WO 2018032007 2/2018

OTHER PUBLICATIONS

Extended European Search Report and Written Opinion in related European Application No. 14869433.4, 8 pages, dated Oct. 5, 2017.
(Continued)

*Primary Examiner* — Jennifer Robertson
(74) *Attorney, Agent, or Firm* — Craige Thompson; Thompson Patent Law

(57) ABSTRACT

Apparatus and associated methods relate to a walking therapy station having multiple right linkages and multiple left linkages, where at least one of the right or left linkages is operably coupled to an actuator to transition the station from a standing mode to a walking mode. In an illustrative example, the station may have five right linkages and five left linkages, with a set of knee pads and foot pads. The station may include an actuator operably coupled to transition the station between walking and standing modes, for example. Various embodiments of the station may enable a user who is disabled or paralyzed to transition from sitting position, to a standing position, and then to a walking position, and provide the user with a very accurate gait and walking motion without putting excessive shear and pressure at the contact points between the station and the user.

19 Claims, 14 Drawing Sheets

(52) U.S. Cl.
CPC ..... *A63B 2022/0094* (2013.01); *A63B 2208/0204* (2013.01); *A63B 2208/0233* (2013.01); *A63B 2225/09* (2013.01)

(56) References Cited

U.S. PATENT DOCUMENTS

| | | | | |
|---|---|---|---|---|
| 9,616,282 | B2 | 4/2017 | Tholkes et al. | |
| 2006/0097557 | A1 | 5/2006 | Tholkes et al. | |
| 2009/0011910 | A1* | 1/2009 | Lai ..... | A63B 22/001 482/131 |
| 2010/0121232 | A1 | 5/2010 | Sankai | |
| 2010/0270771 | A1 | 10/2010 | Kobayashi et al. | |
| 2015/0165265 | A1* | 6/2015 | Tholkes ..... | A63B 22/0664 482/54 |
| 2017/0136295 | A1 | 5/2017 | Tholkes et al. | |

OTHER PUBLICATIONS

Examination Report in Related Australian Application No. 2014361932, 3 pages, dated Aug. 16, 2018.
International Preliminary Report on Patentability in related International Application No. PCT/US2017/046788, dated Feb. 21, 2019, 6 pages.

* cited by examiner

WALK THERAPY STATION

CROSS-REFERENCE TO RELATED APPLICATIONS

This application also claims the benefit of U.S. Provisional Application Serial No. 62/569,378 titled "Natural Assist Simulated Gait Therapy Adjustment System," filed by Tholkes, et al., on Oct. 6, 2017.

This application incorporates the entire contents of the foregoing application(s) herein by reference.

TECHNICAL FIELD

Various embodiments relate generally to physical therapy systems.

BACKGROUND

There are approximately twelve thousand spinal cord injuries (SCI) per year in the United States alone. The average age of an injured person is twenty-eight years old. There are approximately three-hundred thousand people with SCIs in wheelchairs in the United States. In addition to SCIs, there are also many thousands of cases of strokes as well as thousands of cases of multiple sclerosis (MS) diagnoses each year in the United States. Furthermore, many other neurological problems afflict people and confine them to wheelchairs. The numbers of such cases world-wide is commensurately larger yet.

Providing such physically afflicted individuals an ability to stand may help maintain and improve their health. Walking therapy may restore function in SCI individuals and in those who have suffered paralyzing strokes. The beneficial results from walking therapy may be enhanced if the paralyzed individual can consistently and regularly perform the therapy. Mental health benefits may accrue as well to SCI individuals who may independently exercise or practice therapy.

SUMMARY

Apparatus and associated methods relate to a walking therapy station having multiple right linkages and multiple left linkages, where at least one of the right or left linkages is operably coupled to an actuator to transition the station from a standing mode to a walking mode. In an illustrative example, the station may have five right linkages and five left linkages, with a set of knee pads and foot pads. The station may include an actuator operably coupled to transition the station between walking and standing modes, for example. Various embodiments of the station may enable a user who is disabled or paralyzed to transition from sitting position, to a standing position, and then to a walking position, and provide the user with a very accurate gait and walking motion without putting excessive shear and pressure at the contact points between the station and the user.

Various embodiments may achieve one or more advantages. For example, some embodiments may provide physical therapy to disabled or paralyzed users to increase their mobility and muscle memory. Some examples may provide for resistance to a user to push their physical stamina and improve the strength of their muscles and level of muscle control. A station may easily allow a paralyzed user to transition into the machine by a walker or wheelchair, for example. Some embodiments may provide for a system that guides a user's feet through a very natural gait motion with a natural heel strike motion and toe lift motion. Various examples may include multiple support points (such as knee, foot, buttocks, hip, and chest pads) to keep a paralyzed user standing upright. The station may include various sensors to detect positions of a user's legs and accurately time/calibrate the power delivered by a motor that drives the linkages to simulate a user's natural gait motion. The station may have, for example, various adjustment features to accommodate users of different heights, weights, or sizes. A frame of the station may advantageously collapse to allow for easy shipping and transportation of the station. Various embodiments may include an actuator to facilitate lifting of an individual from a sitting to a standing position. Some implementations may employ a flywheel to smooth motion of the linkages of the station. Some implementations may be motor-less, which may beneficially allow for users with some mobility to adjust a level of difficulty customized to their needs, and some implementations may include a motor for guiding a paralyzed user through natural gait motions for rehabilitation purposes.

Various embodiments may achieve other advantages. For example, some embodiments may promote healthy bones by standing users without individual assistance. Standing therapy may promote skin integrity as well as vital organ functions such as renal functions (e.g., bladder, kidneys). Walking therapy may promote bone integrity, range of motion as well as the benefits mentioned for standing therapy. Physicians and patients may benefit from the tele-rehabilitation aspects of the walking therapy station, for example, and physicians may monitor patient vital systems and may chart patient progress as the patient progresses through their therapy.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
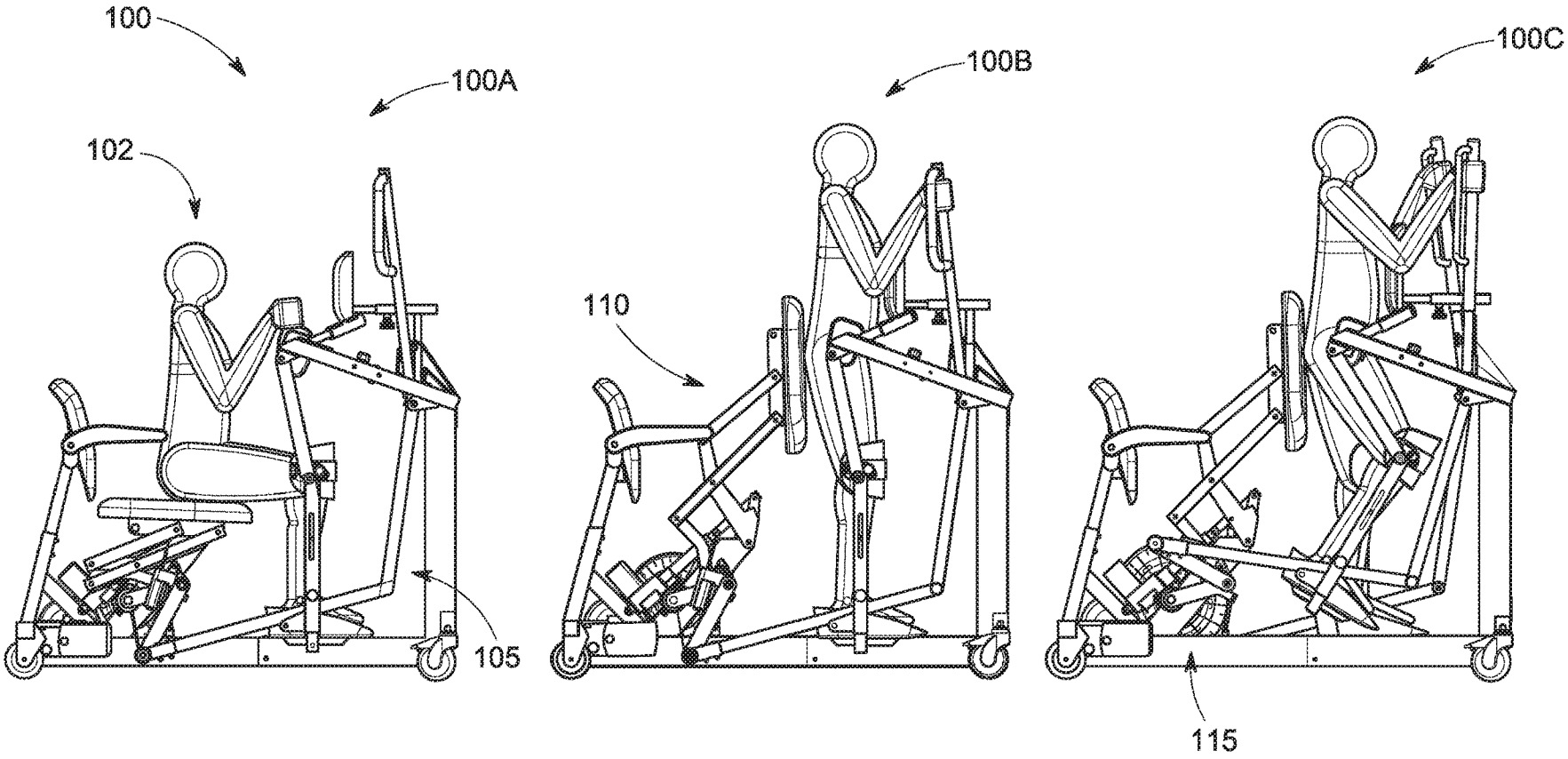
FIG. 1 depicts a right side elevational view of an exemplary walk therapy station in a sitting mode, a standing mode, and a walking mode.

FIG. 1 depicts a right side elevational view of an exemplary walk therapy station in a sitting mode, a standing mode, and a walking mode. A walk therapy station 100 may be employed to provide standing and walking therapies to a mobility-impaired individual. Various aspects of the walk therapy station 100 may be similar to various aspects of the natural assist simulated gait therapy adjustment system (NASGTAS) disclosed in U.S. Provisional Application Ser. No. 62/569,378, titled "Natural Assist Simulated Gait Therapy Adjustment System," filed by Alan Tholkes, et al., on Oct. 6, 2017, the entire contents of which are incorporated herein by reference. From left to right, a walk therapy station 100 is shown in a sitting mode 100A, a standing mode 100B, and a walking mode 100C. A user 102 may enter the walk therapy station 100 while the station is in the sitting mode 100A. For example, the user 102 may transfer into the walk therapy station from a wheelchair. In the sitting mode 100A, the legs of the user 102 are supported and aligned by a knee and foot support system 105. The knee and foot support system 105 includes a set of linkages and knee/foot pads (described further below), which are uniquely designed to emulate a natural walking motion of the user 100 for a very accurate gait/walking motion without putting excessive shear and pressure at the user contact points on the station. When transitioning from the sitting mode 100A to the standing mode 100B, a seat positioning system 110 is used to raise the user 102 up from a sitting position to a standing position. Examples of seat positioning systems are described with reference to, for example, at least FIG. 7 of PCT Application PCT/US17/46788 titled "Natural Assist Simulated Gait Therapy Adjustment System," filed by Alan Tholkes, et al., on Aug. 14, 2017, the entire contents of which are incorporated herein by reference. When transitioning from the standing mode 100B to the walking mode 100C, an actuator-linkage system 115 is used to set a first (right) foot position of the user 102 to a position that is 180° out of phase with a second (left) foot position of the user. For users with a physical disability that affects user's control of their leg muscles, the actuator-linkage system 115 may advantageously transition the physically disabled user from a standing to a walking position quickly and easily to maximize the amount of time the user can spend performing highly beneficial physical therapy. Therapy may be provided to individuals using canes or walkers, for example. Also, those with spinal cord injuries, multiple sclerosis, Parkinson's, stroke hip and knee replacements or the senior population may find benefit in standing and/or walking therapies provided by the walk therapy station. The walk therapy station may be compact and may be used in the home environment (e.g., living room, bedroom).

Figure 2A:
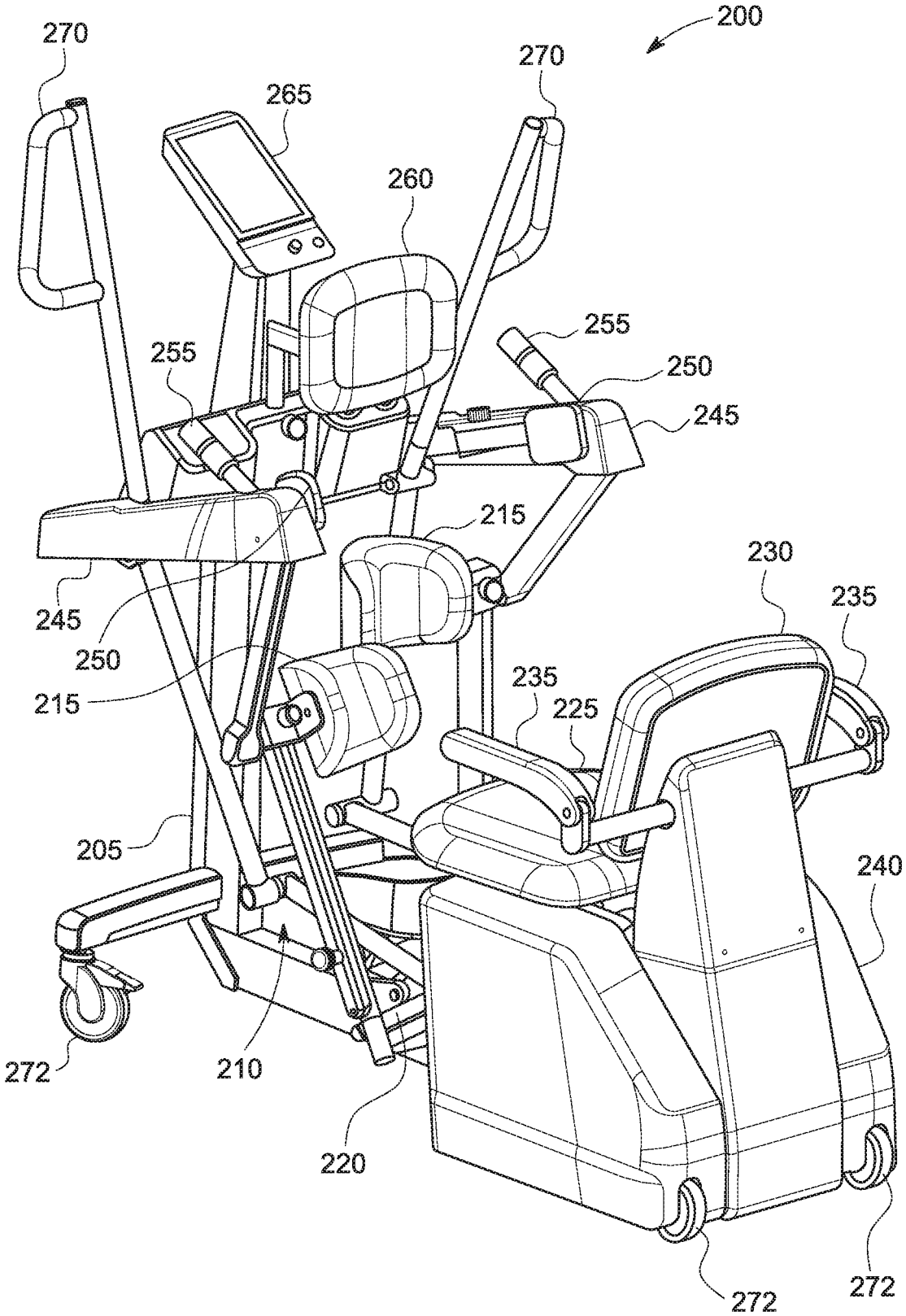
FIG. 2A depicts a back left perspective view of an exemplary walk therapy station with a housing.

FIG. 2A depicts a back left perspective view of an exemplary walk therapy station with a housing. A walk therapy station 200 (with a housing) includes a frame 205. The frame 205 supports a knee and foot support linkage system 210. Mechanically coupled to the support linkage system 210 are a set of knee pads 215 configured to support a user's knee joint. Mechanically coupled to the support linkage system 210 are a set of foot pedals 220 configured to support a user's foot. The station 200 includes a seat 225, which may be a component of the seat positioning system 110 depicted in FIG. 1 and detailed in FIG. 3B below. The station 200 includes a back support 230, which may give a user back support while sitting in the station 200 during a sitting mode. The station 200 includes a set of arm rests 235, which may be mechanically coupled to the frame 205. The station includes a housing 240 configured as a protective barrier to house various components of the station 200 (e.g., electronics, a motor, actuators).

The station 200 includes a pair of upper support members 245 that may be mechanically coupled to the frame 205. Mechanically coupled to each upper support member 245 is a hip pad 250 configured to properly align a user's hips while inhabiting the station 200 during a standing mode. Mechanically coupled to each upper support member 245 is a handle bar 255, which may be a heart-rate monitor handle bar. Mechanically coupled to the frame 205 is a chest pad 260 configured to properly align a user's chest and upper body while inhabiting the station 200 during a standing mode. Supported by the frame 205 is a user interface device 265, which may be a tablet or touch screen computer, for example. Mechanically coupled to the support linkage system 210 are a pair of handle bars 270 that perform opposing oscillatory motion when a user is practicing walking in the station 200. The station 200 includes several wheels 272 used for transporting the station 200.

The controls of the station 200 may control actuation of a stand-to-walk (SWM) mechanism and/or a sit-to-stand mechanism. For example, the control that operates an actuator to lift a user from sitting to standing and the control to operate the actuator that transitions the user from standing to walking may be located in the front area of the station 200 (e.g., the two switches below front support pad 260 and on the right side of the station 200 in FIG. 2A). Each switch may be positioned so the user can access them from either a sitting or a standing position.

Figure 2B:
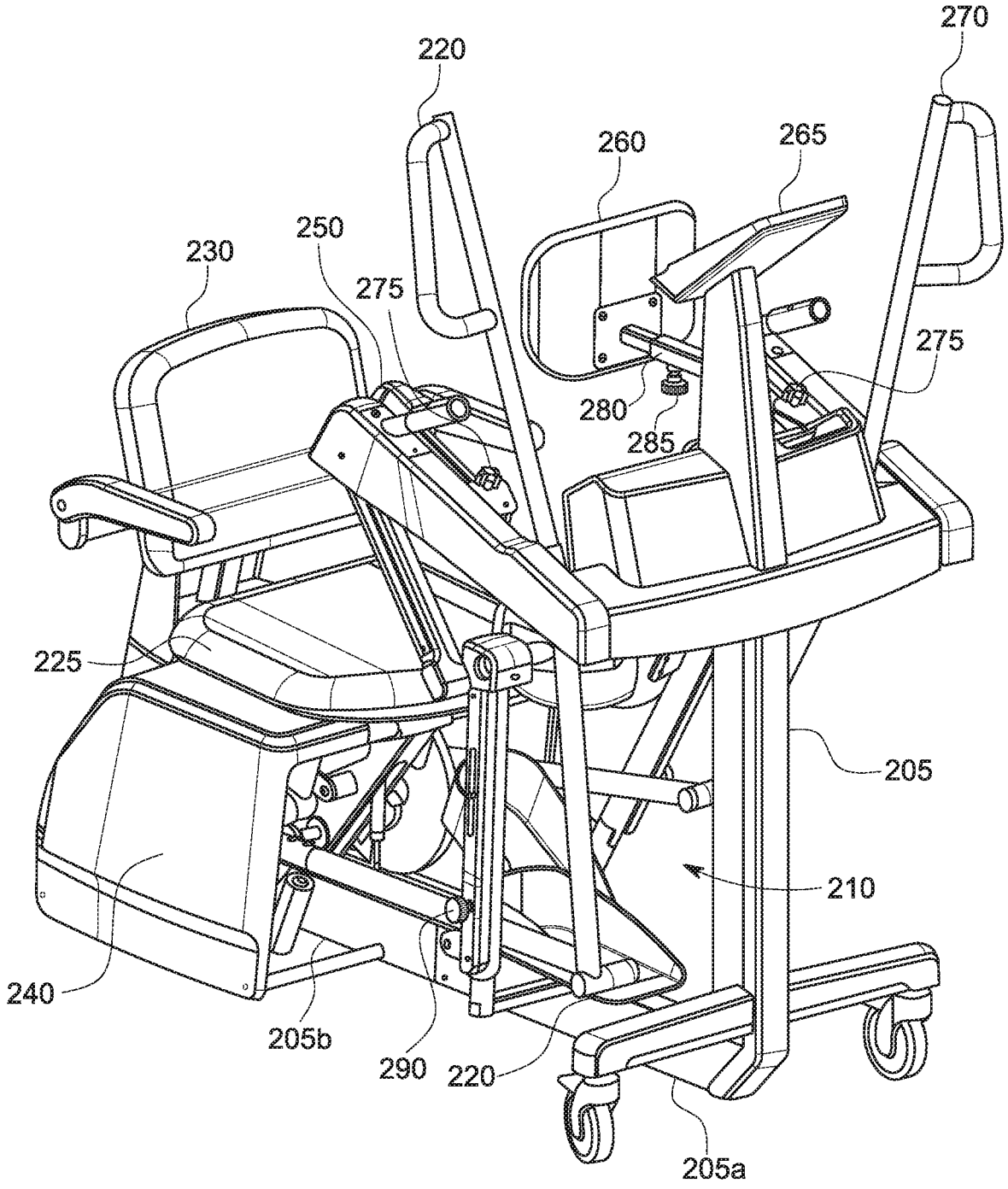
FIG. 2B depicts a front right perspective view of an exemplary walk therapy station with a housing.

FIG. 2B depicts a front right perspective view of an exemplary walk therapy station with a housing. The hip pad 250 may be pivotably coupled to the frame 205. The angular position of hip pad 250 may be (pivotably/hingedly) selectively adjustable using a hip pad plunger 275 configured to lock the hip pad 250 into a position. Selective adjustment of the hip pad 250 position may allow for customization of the station 200 for people having varying hip dimensions. The forward or backward position of the chest pad 260 may be selectively adjustable using a chest pad plunger 285. The chest pad plunger 285 may lock the chest pad 260 into place by configuring an extension distance of a telescoping chest pad extension member 280, which is mechanically coupled to the frame 205. The height of each foot pedal 220 may be selectively adjustable using a foot pedal plunger 290. Various plungers may be spring-loaded plungers, for example. The frame 205 includes a front section 205A and a back section 205B. In some examples, the front and back frame sections may decoupleable, such that the front section 205A may be disconnected from the back section 205B. Such disconnection may advantageously allow for compact and efficient transportation of a collapsed station 200.

Figure 3A:
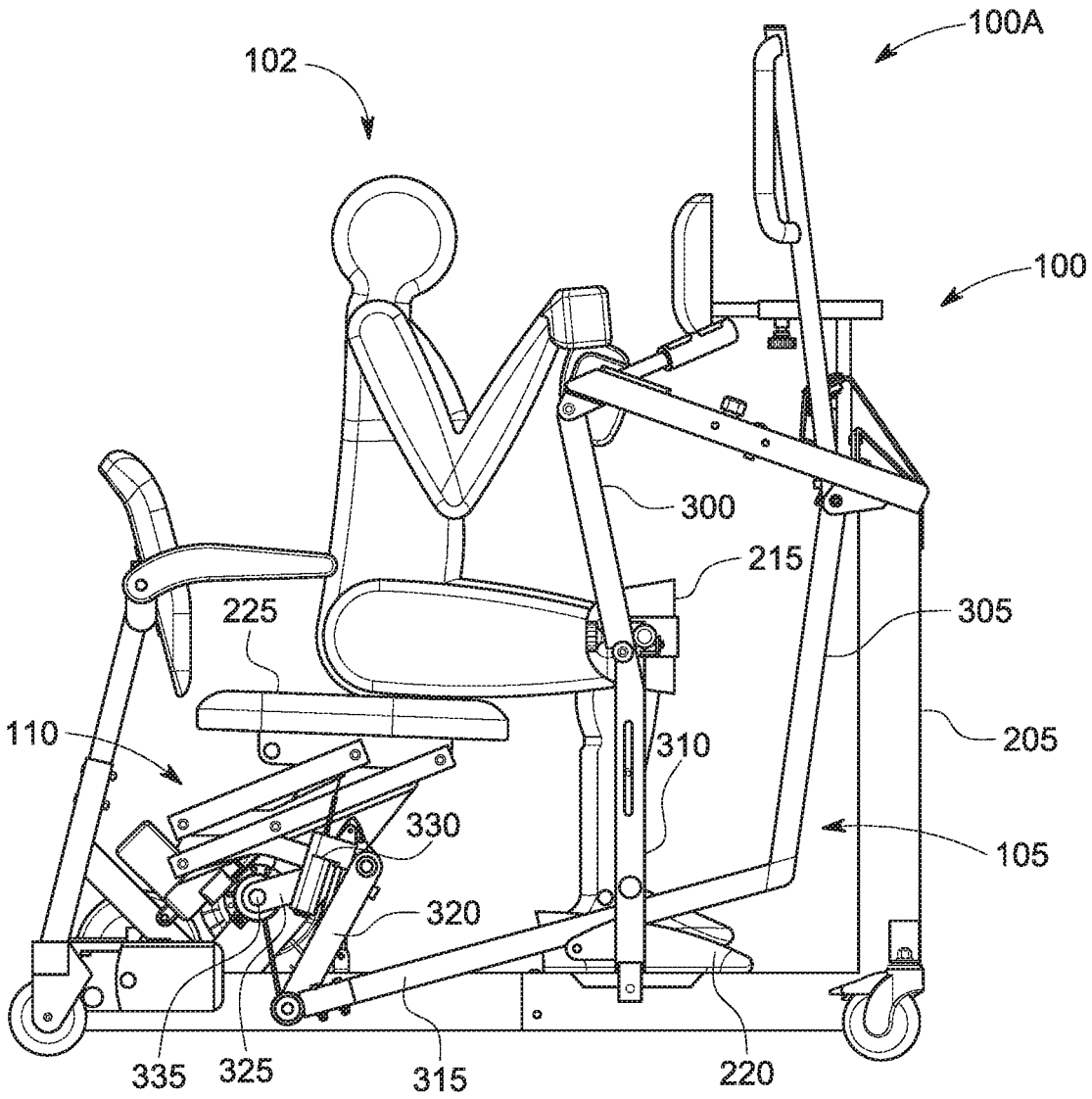
FIGS. 3A, 3B, and 3C depict right side elevational views of an exemplary walk therapy station in a sitting mode, a standing mode, and a walking mode, respectively.
Figure 3B:
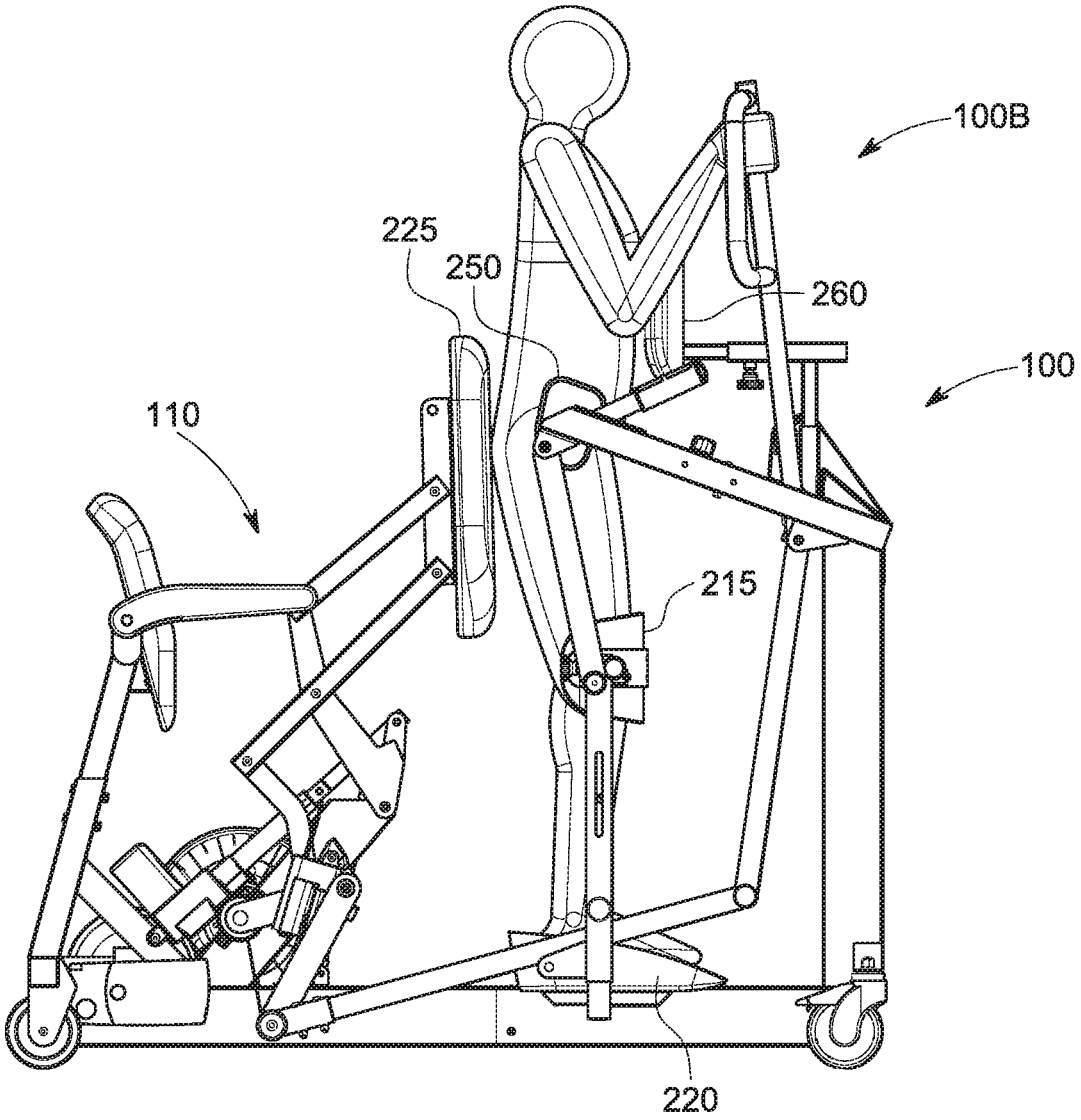
Figure 3C:
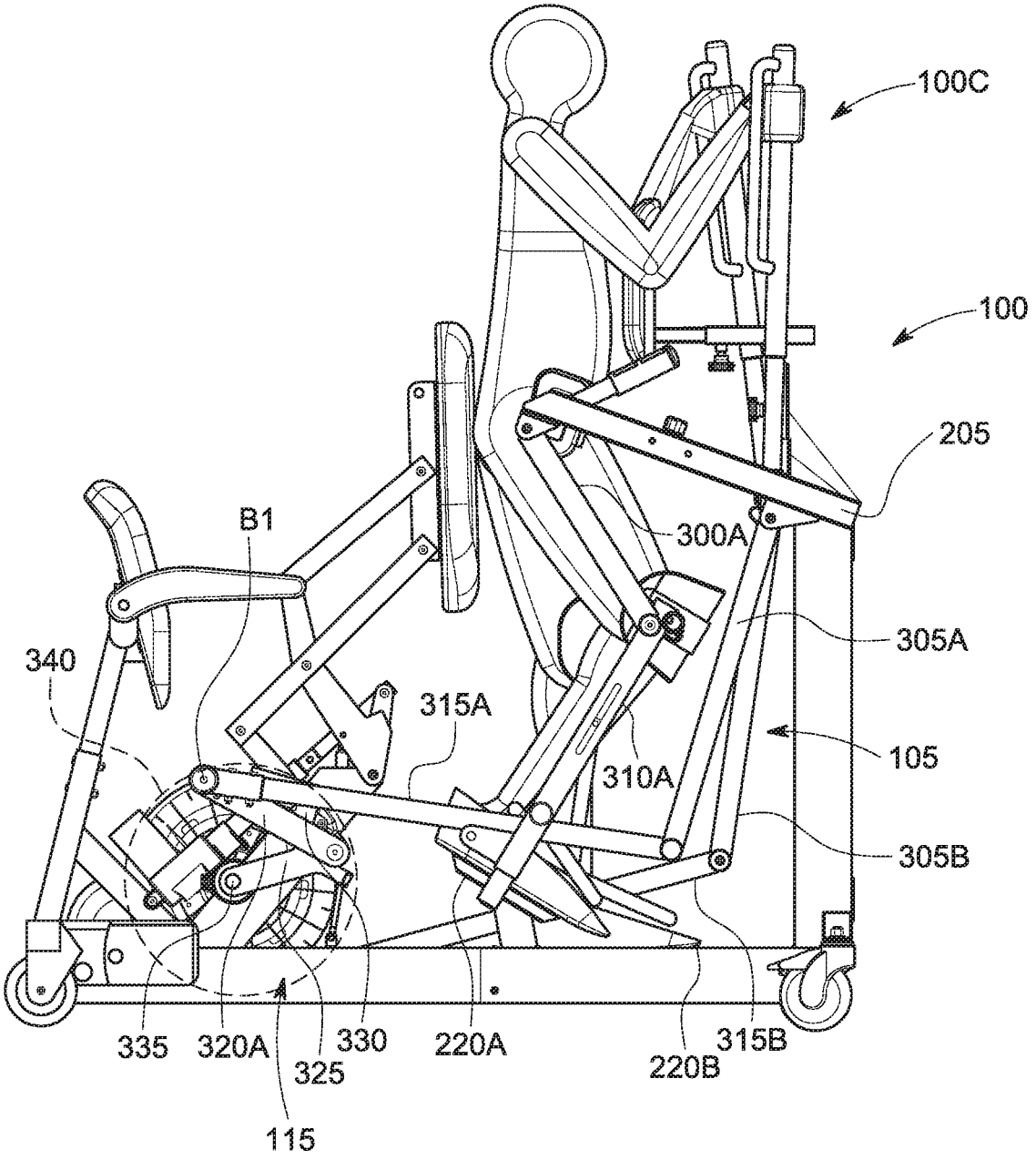

FIGS. 3A, 3B, and 3C depict right side elevational views of an exemplary walk therapy station in a sitting mode, a standing mode, and a walking mode, respectively. The walk therapy station 100 includes the seat 225. Initially, a user 102 may transition into the seat 225 of the station 100 from a wheelchair, cane, walker, or from a standing position, for example. The seat 225 is hingedly coupled to a scissors linkage subsystem that is included with a seat positioning system 110. The station 100 is configured to transition between a sitting position (shown here in FIG. 3A) and a standing position (shown in FIG. 3B).

The knee and foot support system 105 includes a number of linkages configured to support and dictate the movement patterns of the legs and feet of the user 102. At least some of the linkages (and their coupling points) on the right side of the 105 system may substantially mirror the linkages on the left side of the system 105 (and vice-versa). The support system 105 includes a first linkage 300 pivotably coupled at a proximal end to a frame 205 of the station 100. The support system 105 includes a second linkage 305 pivotably coupled at a proximal end to the frame 205. In the depicted example, the coupling point between the first linkage 300 and the frame 205 is located behind the coupling point between the second linkage 305 and the frame 205. A third linkage 310 is pivotably coupled at a proximal end to a distal end of the first linkage 300. A knee pad 215 is mechanically coupled to either or both of the first and the third linkages at a location proximate to the pivotal coupling point between the first and third linkages. The first, second, and third linkages 300, 305, 310 may be oriented in a substantially vertical orientation during sitting/standing modes 100A, 100B of the station 100. A fourth linkage 315 is pivotably coupled at a proximal end to a distal end of the second linkage 305. The fourth linkage 315 is also pivotably coupled at a point along a length of the fourth linkage 315 to a point along a length of the third linkage 310. The fourth linkage 315 may be oriented in a substantially horizontal orientation during sitting/standing/walking modes 100A, 100B, 100C of the station 100. A fifth linkage 320 is pivotably coupled at a proximal end to a distal end of the fourth linkage 315. The fifth linkage 320 is mechanically coupled (via an intermediate linkage 325) to a fixed rotational axis 335, which may be coaxially aligned with a crankshaft, for example. Operably coupled to the fifth linkage 320 is an actuator 330, which may be a linear actuator, for example. The design, couplings, and layout of the support system 105 may advantageously provide a mobility-impaired individual with a range of motion for their legs and feet that closely mimics a natural walking/gait motion of the individual, thus allowing the individual to receive physical therapy using the station 100 to train their leg and feet muscles for proper gait motion.

FIG. 3B depicts a right side elevation view of the user within an exemplary walk therapy system in a standing mode, where the user is standing after the seat is raised but before active therapy. In this exemplary depiction, the station 100 has raised the user 102 to a standing position by employment of the seat positioning system 110. The seat positioning system 110 is configured to lift the user in such a manner to substantially minimize any shifting/shearing of the buttocks of the user 102 across the surface of the seat 225. The station 100 includes a pair of knee saddles 215. The knee saddles 215 stabilize the knees of the user 102, as the seat 225 is transitioned between the sitting position and the standing position. Once fully transitioned to the standing position, the user is securely positioned within the station by the following support points: foot pedals 220, knee saddles 215, seat 225, hip pads 250, and chest pad 260.

In various embodiments, the scissors linkage subsystem of the seat positioning system 110 (for raising a person from a sitting position to a standing position) may be included in a sit-to-stand transmission system. Such sit-to-stand transmission systems are described, for example, in at least FIG. 2, in U.S. patent application Ser. No. 14/529,568, titled "Multi-Modal Gait-Based Non-Invasive Therapy Platform," filed by Alan Tholkes on Oct. 31, 2014, the entire disclosure of which is hereby incorporated by reference. The scissors linkage subsystem of the seat positioning system 110 is disclosed in detail, for example, in at least FIGS. 5C, 6A and 7, with reference to application serial No. PCT/US17/46788, titled "Natural Assist Simulated Gait Therapy Adjustment System," filed by Alan Tholkes, et al., on Aug. 14, 2017, the entire disclosure of which is hereby incorporated by reference.

In an exemplary embodiment, the lifting of the seat 225 and the user's body seated in the seat may be performed using various lifting mechanisms. An opening module may be used to lift the seat 225 and the user 102. In some embodiments, a lifting handle may be coupled to the opening module. The lifting handle may be positioned within the reach of the user 102 throughout the lifting process, so that a user who has hand strength may independently lift themselves from the sitting position to the standing position. In some embodiments, the lifting handle may be long to provide mechanical leverage to facilitate the ease of lifting the seat 225 and user 102. Various opening modules 102 for lifting the seat 225 from a sitting position to a standing position may be employed. For example, a hydraulic pump may be used as an opening module. The hydraulic pump may provide a smooth operation. In addition, the hydraulic pump may provide shock absorption.

In some examples, an electric motor may be used to lift the seat 225 and the user 102. In an exemplary embodiment, a mechanical screw thread may be used to lift the user to a standing position. Some examples may use an electric hydraulic pump as a lifting module. In various examples, gas springs may be used for lifting the seat 225 and user 102 from a sitting position to a standing position. In some embodiments, the lifting module may include a mechanical lever to drive a telescoping member, for example. Such mechanical levers have been described, for example, in at least FIG. 6 of U.S. Provisional Patent Application Ser. No. 62/374,383 titled "Natural Assist Simulated Gait Therapy Adjustment System," filed by Alan Tholkes et al., on Aug. 12, 2016, the entire contents of which is hereby incorporated by reference.

FIG. 3C depicts a right side elevation view of the user 102 within an exemplary walking therapy station, in a final preparation (walking) state, the user 102 now being ready for active therapy. The preparation states prepare the user by first making the transition from sitting to standing, then by making the transition between a standing position and a walking position. The transition from standing to walking is described with reference to FIGS. 4, 5, 6 and 7 of U.S. Provisional Application Ser. No. 62/569,378 incorporated herein by reference. Although the depicted embodiment in various figures may be configured with the actuator 330 on the right side of the station 100, persons of ordinary skill in the art will appreciate upon reading this disclosure that the orientation could be reversed (e.g., the actuator 330 could be on the left side of the station 100). Moreover, various features shown on the left side of the station 100 may instead be located on the right side of the station 100 (and vice-versa).

A stand-to-walk mechanism (SWM) is shown, including the actuator 330 that is hingedly/pivotably coupled between the right intermediate linkage 325 and the right fifth linkage 320A. The right intermediate linkage 325 is fixedly coupled at a distal end to the (right end of the) crankshaft 335. The right intermediate linkage 325 is hingedly coupled at a proximal end to the right fifth linkage 320A. The right fifth linkage 320A is hingedly coupled to a right fourth linkage 315A. The right fourth linkage 315A is hingedly coupled to a right third linkage 310A. The right third linkage 310A is adjustably coupled to a right foot pad 220A. The right fourth linkage 315A is hingedly coupled to a right second linkage 305A. The right second linkage 305A is hinged at a point on the frame 205. The frame 205 is hingedly coupled to a right first linkage 300A. The right first linkage 300A is hingedly coupled to the right third linkage 310A. In an operational mode (e.g., while the user 102 is moving through walking/gait motions in the station 100), the proximal end of the right fifth linkage 320A travels in a substantially circular path 340 having a center point aligned with the fixed rotational axis 335 (e.g., crankshaft).

The SWM being located in a lower back position of the station 100 allows the user 102 to enter the station 100 from either the left or right side. In operation, as the SWM is retracted, the proximal end of the right fifth linkage 320A rotates clockwise (from the perspective of the right-side elevational view of FIG. 3C). In some examples, the proximal end of the right fifth linkage 320A may instead rotate counter-clockwise (from the perspective of the right-side elevational view of FIG. 3C) to transition from standing to walking modes. As the proximal end of the right fifth linkage 320A rotates clockwise, the distal end of the right fourth linkage 315A is driven toward the rear of the station 100 (toward the left with respect to FIG. 3C). As the distal end of the right fourth linkage 315A is driven toward the rear of the station 100, a pivot point B1 (associated with the proximal end of the right fifth linkage 320A and a distal end of the right fourth linkage 315A) is driven toward the rear. As pivot point B1 is driven toward the rear, the right foot pan 220A is brought toward the rear of the station 100, is lifted, and is angled forward as dictated by the frame 205 and the right linkages 300A, 305A, 310A, 315A, 320A, and 325. This lifted and forward angled position of the right foot pan 220A prepares the user's right leg and foot for walking within the station 100. The SWM is further retracted to complete the transition of the final preparation (walking) state. When the SWM has completed its retraction, pivot point B1 is moved to the position shown in FIG. 3C. In addition, by the retraction of the SWM, a right side effective crank is formed by the right linkages 325 and 330, and the SWM. This right-side effective crank is substantially 180 degrees from the position of the left-side crank, which will be introduced in FIG. 5. The full retraction of the SWM transitions pivot point B1 to the opposite side of the rotational axis defined by the crankshaft 335. This transition places pivot point B1 and its counter pivot point on the left side of the station 100 on opposite sides of the crankshaft 335. Such a configuration may result in, during a walking mode, the left and right cranks being pointed substantially 180° from each other, and when in sit or stand mode, cranks may both be pointed substantially in the same direction.

Figure 4:
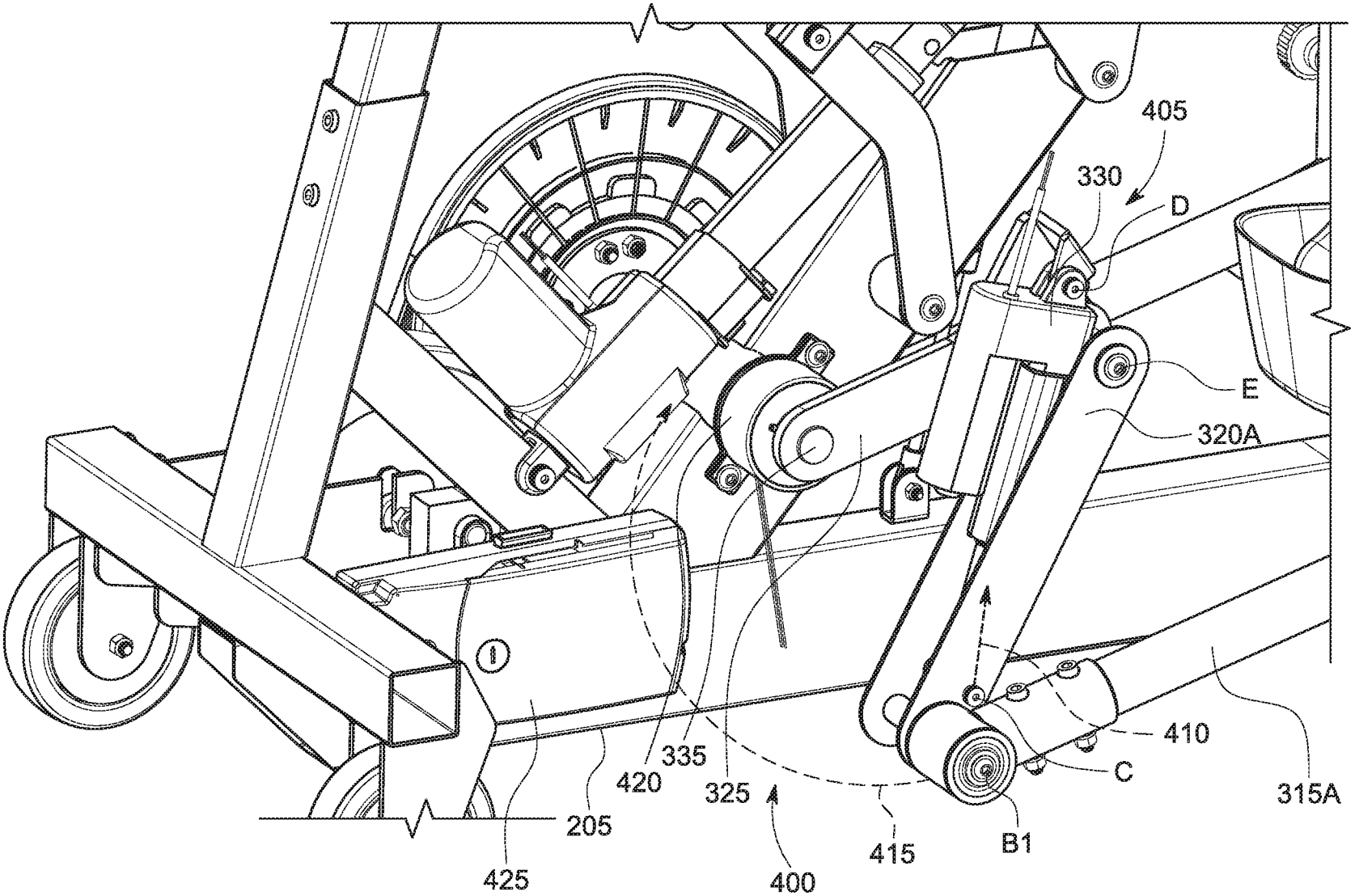
FIG. 4 depicts a back right perspective detail view of an exemplary actuator system of a walk therapy station.

FIG. 4 depicts a back right perspective detail view of an exemplary actuator system of a walk therapy station. FIG. 4 also depicts a stand-to-walk subsystem of an exemplary station 100, showing detail of the right crank members and the SWM in a standing state. A stand-to-walk system 400 includes an SWM 405, including the actuator 330 (shown previously in FIGS. 3A-3C). The actuator 330 may couple to a power system of the station 100 via wires and slip ring 420 (discussed further below), for example, to operate/power a motor of the actuator 330. The SWM 405 is shown in standing mode. In standing mode, pivot point B1 (FIG. 4) and pivot point B2 (FIG. 6A) are aligned with one another (in phase).

Figure 6A:
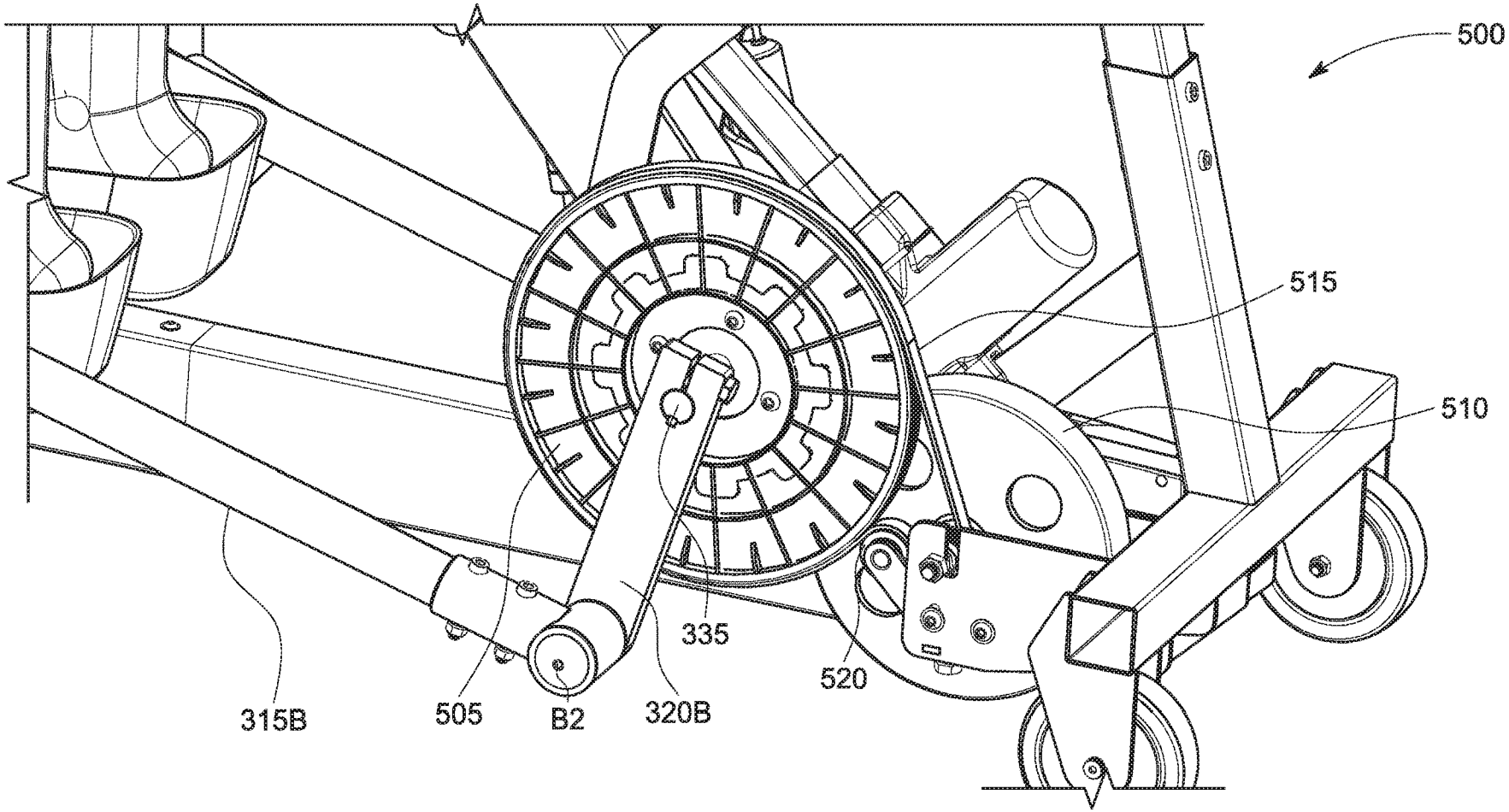
FIG. 6A depicts a back left side perspective view of an exemplary subsystem of a walk therapy station including a left crank, left-crank resistance-wheel, flywheel, and pretensioner.

The actuator 330 is hingedly coupled to an intermediate linkage 325. The intermediate linkage 325 is fixedly coupled to the crankshaft 335. The crankshaft 335 may extend to the left side of the stand-to-walk system 400 as depicted in FIG. 6A. In FIG. 6A the crankshaft 335 is depicted as extending laterally across the station 100. The intermediate linkage 325 is hingedly coupled to the fifth linkage 320A at pivot point E. The actuator 330 is hingedly coupled at a proximal end to the fifth linkage 320A at point C. The actuator 330 is hingedly coupled at a distal end to the intermediate linkage 325 at point D. The right fifth linkage 320A is hingedly coupled to the right fourth linkage 315A.

In operation, as the stand-to-walk system 400 transitions between standing mode and walking mode, the actuator 330 is retracted upward, as indicated by path 410. As the actuator 330 is retracted upward, pivot point B1 is raised (rotated) to the opposite side of the crankshaft 335, as indicated by path 415. When the actuator 330 is fully retracted, pivot point B1 and pivot point B2 (FIG. 6A) are on opposite sides of the crankshaft 335, similar to the pedals and crank on a bicycle (180° out of phase).

The axis of the crankshaft 335 is held at fixed position relative to the frame 205. The stand-to-walk system includes a slip ring 420. The slip ring 420 is fixedly coupled to the intermediate linkage 325. The two outer surfaces of the slip ring 420 are rotatably coupled. The actuator 330 is hingedly coupled to the intermediate linkage 325. The actuator 330 is electrically powered, and receives power from a power supply 425. The power supply 425 is fixed relative to the frame 205. The power from the power supply 425 is supplied to the actuator 330 via the slip ring 420. The slip ring 420 is configured to transmit power from a stationary member (e.g., an outer housing of the crankshaft 335) to a rotating member (e.g., the intermediate linkage 325). In this way, the rotating SWM 405 may receive power from the stationary power supply 425. For example, there may be wires that go between the rotating side of the slip ring 420 and the actuator 330, and there may be wires from the power supply 425 to the stationary side of the slip ring 420.

Figure 5:
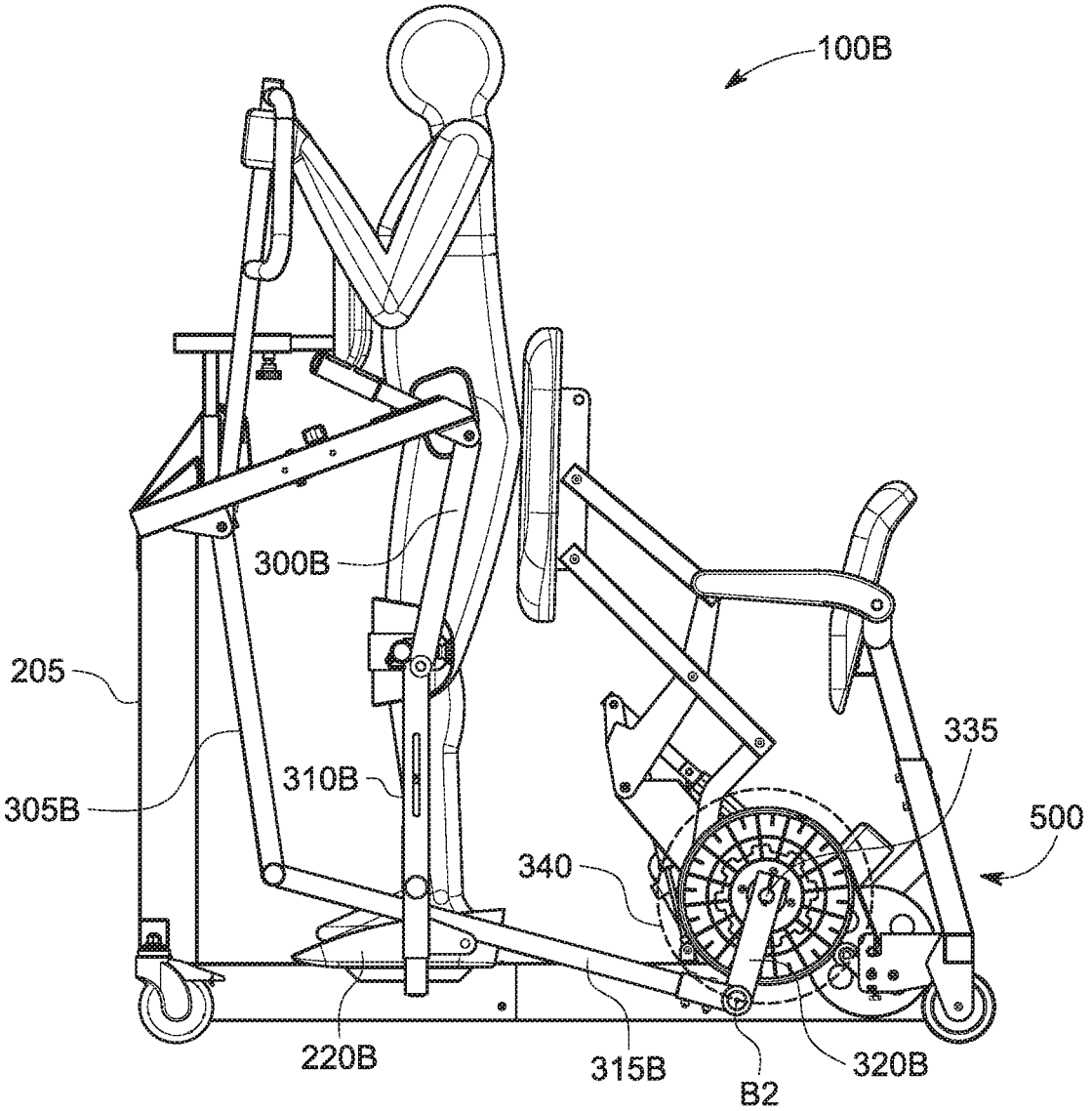
FIG. 5 depicts a left side elevational view of an exemplary walk therapy station.

FIG. 5 depicts a left side elevational view of an exemplary walk therapy station. A left fifth linkage 320B is fixedly coupled at a distal end to a (left end of the) crankshaft 335. The left fifth linkage 320B is hingedly coupled at a proximal end to a left fourth linkage 315B. The left fourth linkage 315B is hingedly coupled to a left third linkage 310B. The left third linkage 310B is adjustably coupled to a left foot pad 220B. The left fourth linkage 315B is hingedly coupled to a left second linkage 305B. The left second linkage 305B is hinged at a point on the frame 205. The frame 205 is hingedly coupled to a left first linkage 300B. The left first linkage 300B is hingedly coupled to the left third linkage 310B. In an operational mode (e.g., while the user 102 is moving through walking/gait motions in the station 100), the proximal end of the left fifth linkage 320B (signified by point B2) travels in a substantially circular path 340 having a center point aligned with the fixed rotational axis 335 (e.g., crankshaft). In the standing mode 100B shown in FIG. 5, both points B1 and B2 are aligned and in phase with one another, while in the walking mode 100C shown in FIG. 3C, the points B1 and B2 are on opposite sides of the crankshaft 335 and 180° out of phase with one another.

Included with the station 100 is a wheel and belt subsystem 500. The subsystem 500 includes various parts that may smooth a walking motion of the user 102 while utilizing the station 100. The subsystem 500 may also include various structures that may impose resistance to a walking motion. Various aspects of the subsystem 500 may be adjusted, tuned, or user-selectable (e.g., adjustable resistance). In this sense, the subsystem 500 may advantageously provide a user-customizable resistance setting that can be tuned specifically to the muscle strength and level of control of a given user 102. The station 100 may be a drive-less or motor-less station, while the station 700 (FIG. 7) may be a driven or motor-powered station. In some examples, the handle bars 270 of the station 100 may be used by a user to drive the gait motion of the support linkage system 210 (e.g., for users having upper body and arm control/strength but without sufficient control/strength of/in their lower extremities).

FIG. 6A depicts a back left side perspective view of an exemplary subsystem of a walk therapy station including a left crank, left-crank resistance-wheel, flywheel, and pretensioner. A wheel and belt subsystem 500 includes a left crank resistance/pulley wheel 505. The wheel 505 is in a fixed position relative to the crankshaft 335 (e.g., wheel 505 may be fixedly coupled to the crankshaft 335). The crankshaft 335 (as explained above) is fixedly coupled to a fifth left linkage 320B, which is in turn, hingedly coupled to a fourth left linkage 315B. Coupled to the wheel 505 (via belt 515) is a flywheel 510, which may provide various smoothing aspects to the station 100 while in walking mode 100C. The belt 515 is engaged with a pretensioner 520, which may set a level of tension in the belt 515. In some examples, the pretensioner 520 may be referred to as a pre-tensioning pulley. The belt tensioner 520 may be used to adjust the belt to keep it from slipping.

The pulley wheel 505 is rigidly coupled to shaft 335. In some embodiments, a large diameter pulley wheel 505 (e.g., about 8" in diameter) may result in a better ratio to drive the flywheel 510 at a faster speed for a smoother walk motion. The speed of the flywheel 510 may be important in creating the ability to control resistance with magnets using an eddy current effect. In various embodiments, at least one of the wheels of the station (e.g., wheel 505 or 510) may be an eddy-current brake wheel. For example, a small motor may position magnets closer to the spinning flywheel 510, thus allowing for a customizable and user-selectable level of resistance for the walk therapy station 100. The eddy effect resistance may be controlled by an adjustment motor with a switch by the user interface 265, for example. In at least one embodiment, there are at least two buttons/selection mechanisms on the front end of the station 100: one button that controls resistance, and another power button for the display 265. In some examples, all or at least some motors of the station (and possibly the display 265) may be powered by the same power supply 425.

For the version of the station with the motor assist (e.g., the station 700 depicted in FIGS. 7 and 8 and discussed in depth below), a flywheel may be mounted on the motor for a smooth walk when not using/energizing the motor. When a user does not use the walking motor and instead walks manually, the motor may be used to create resistance by applying power to the motor to create resistance rather than assist in walking. A large pulley wheel may also provide more torque for the motor to rotate the shaft 335, so the station can move the legs of the user at a very slow speed.

Figure 6B:
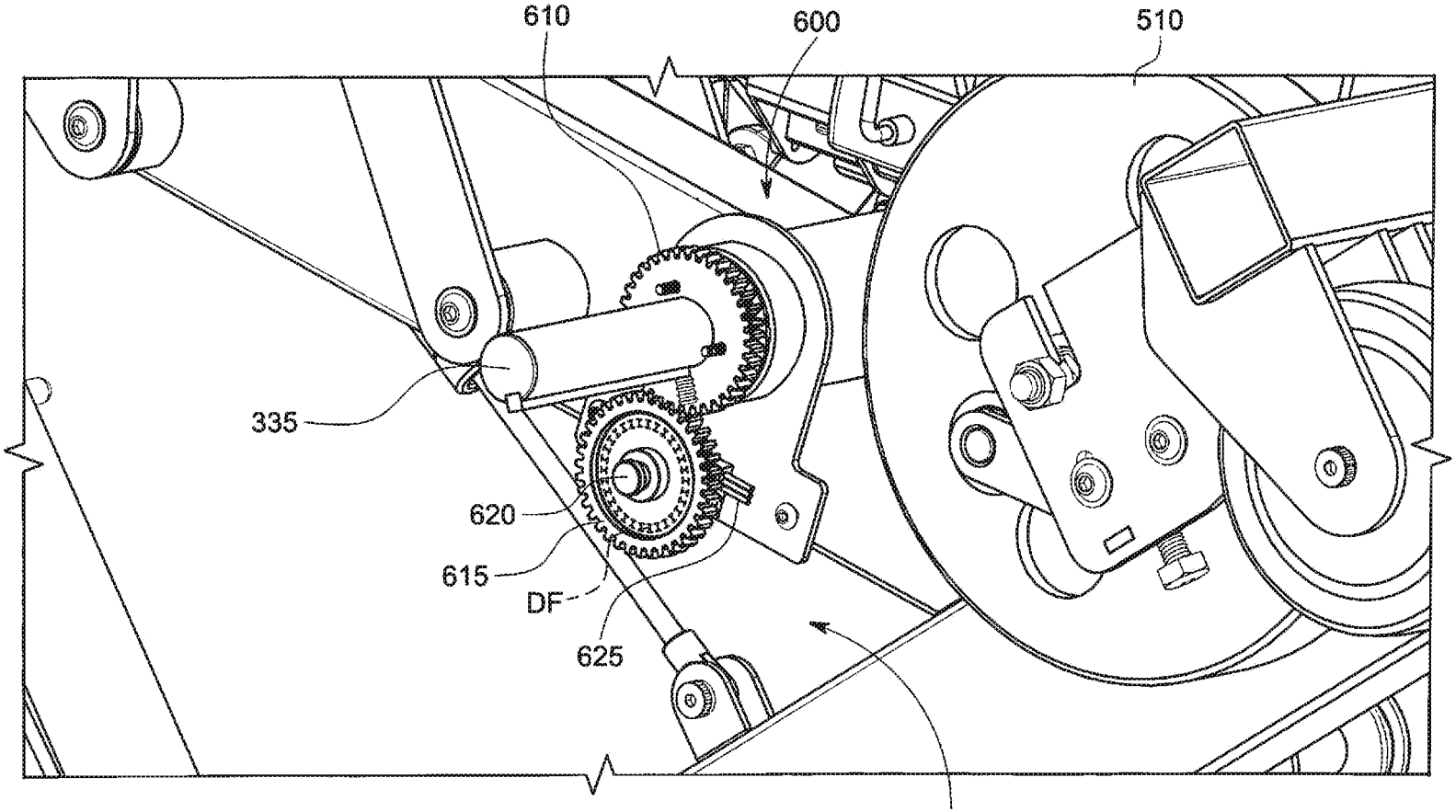
FIG. 6B depicts a back left side perspective view of an exemplary position measurement system for a walk therapy station including a position sensor.

FIG. 6B depicts a back left side perspective view of an exemplary position measurement system for a walk therapy station including a position sensor. A left back side perspective view 600 of the station 100 is shown with the linkage 320B, wheel 505, and belt 515 removed, for purposes of illustrating a position tracking/measurement system 605. The measurement system 605 includes the (keyed) crankshaft 335. Fixedly coupled to the crankshaft 335 is a crankshaft gear 610. The rotational axis of the crankshaft gear 610 is aligned with the rotational axis of the crankshaft 335 such that when the crankshaft rotates about its rotational axis, it imparts an equal rotational/angular velocity to the crankshaft gear 610. Gearably coupled/engaged with the crankshaft gear 610 is a position measurement gear 620 configured to rotate about a second rotational axis 615. In some examples, the rotational axis 335 of the gear 610 is substantially parallel to the rotational axis 620 of the gear 615.

Located adjacent to the gear 620 is a position sensor 625. The position sensor 625 may sense (e.g., optically, magnetically, mechanically) the angular position of the gear 620 (e.g., 0-360°). For example, the sensor 625 may be a 360 degree absolute hall sensor. The sensor 625 may collect various types of therapy data, which may include, for example, speed, time walking, leg asymmetry, distance, and time stamp data. In some embodiments, the gear 620 may include a detection feature DF (e.g., an optical encoder disk) that can be detected/measured by the sensor 625 to measure the exact or approximate rotational position of the gear 620. The position measurement gear 620 in conjunction with the sensor 625 facilitates an electrical processor (described later) in determination of the position of the crankshaft 335. Determination of the position of the shaft 335 can be used as an indication of a position of both legs and feet of the user 102. The logging of the position(s) of the legs/feet of the user and/or the linkages of the station 100 over time may advantageously be used to determine instantaneous power requirements and malfunctions of the station 100, or the calories burned or effective distances traveled by a user of the station 100, for example.

The processor controls the SWM 405, and as such, the processor knows the stand-walk state of the stand-to-walk system 400. The processor may determine the overall state of the user's feet with the drive information sent to the SWM 405, and the position information gathered from the sensor 625. This overall state may be advantageously utilized for various purposes as will be shown in further figures and description. The encoder disk DF, the crankshaft 335, the gears 610 and 620, and the sensor 625 may make up an optical encoder module. In an illustrative example, the sensor 625 may facilitate stopping the station 100, such that when the user makes a selection during walking (e.g., using the interface 265), the left leg may continue to move until the station 100 gets into the standing position. Once the station 100 reaches the standing position, it may stop. The right leg may then transition (via the SWM 405) from the walk position to the standing position. This motion may be the reverse of how the station 100 was deployed into the walking position from the standing position.

Figure 6C:
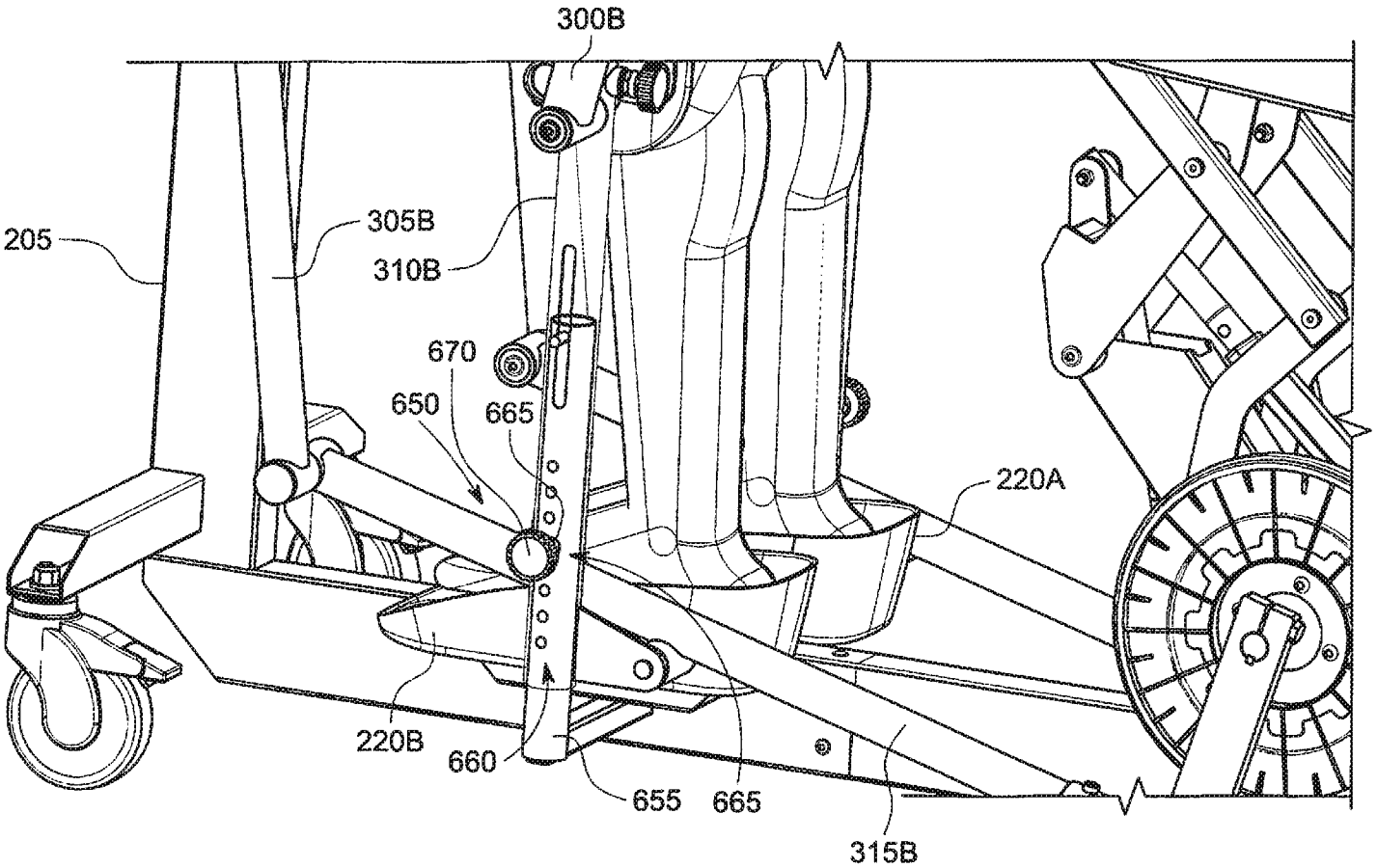
FIG. 6C depicts a back left side perspective view of an exemplary height adjustment system of a walk therapy station.

FIG. 6C depicts a back left side perspective view of an exemplary height adjustment system of a walk therapy station. A height adjustment system 650 is shown with the left third linkage 310B being transparent to illustrate the various features of the system 650. The system 650 includes a left foot pedal 220B. Mechanically and fixedly coupled with the left foot pedal 220B is a telescoping rod 655. The telescoping rod 655 is adjustably coupled to the left third linkage 310B via a plurality of holes 660 of the rod 655, a hole 665 of the left third linkage 310B, and a plunger 670. For example, the plunger 670 may be pulled out of a hole in the plurality of holes 660 by a user to uncouple the rod 655 from the linkage 310B. When the user adjusts the rod 655 to an optimal height (which may be customized to the height of the actual user 102), the plunger may then be inserted into the proper hole of the plurality of holes 660 to set the height of the left foot pedal 220B at a user-selected height. In this sense, the user may adjust the height of the foot pedals of the station 100 for a person of short height (e.g., 4' 10"), medium height (e.g., 5' 8"), or tall height (6' 5"), for example.

It may be understood that the same height adjustment system 650 may be employed on the right side of the station 100 (e.g., as applied to right foot pad 220A). In some examples, the holes 660 may be referred to as apertures, which may be employed to adjust the height of the foot rest to accommodate users of various heights. In some embodiments, the number of apertures may be modified to accommodate smaller ranges, by placing the apertures closer together.

Figure 7:
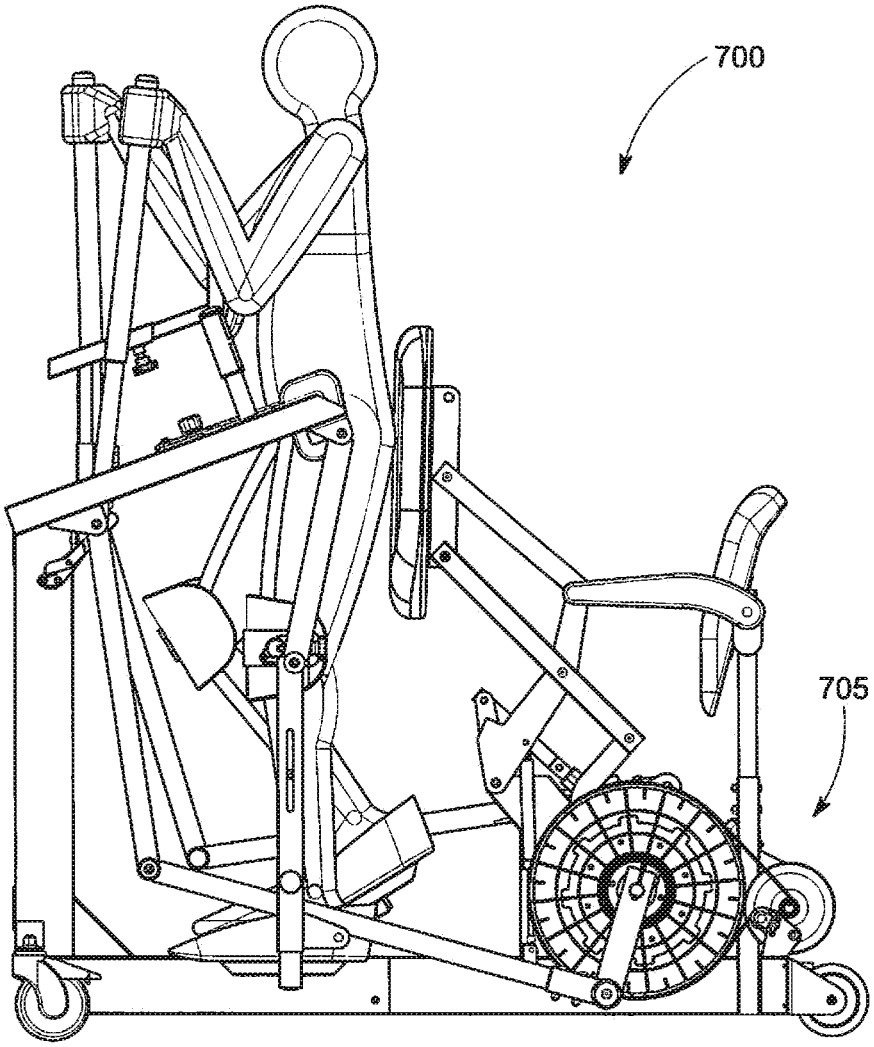
FIG. 7 depicts a left side elevational view of an exemplary walk therapy station implementing a motor to drive movement of the knee and foot support linkage system.

FIG. 7 depicts a left side elevational view of an exemplary walk therapy station implementing a motor to drive movement of the knee and foot support linkage system. A motor-powered station 700 includes many, if not most of the same parts of the non-driven station 100 (e.g., linkages, knee/foot pads, frame, seat). The station 700 includes a motor system 705 configured to drive the linkages of the station 700 to impart a walking motion on a user 102 using the station 700. The motor system 705 may be advantageous for users with minimal mobility in their lower extremities, and may help in providing physical therapy to an individual to build muscle strength and nerve connections for rehabilitation.

Figure 8:
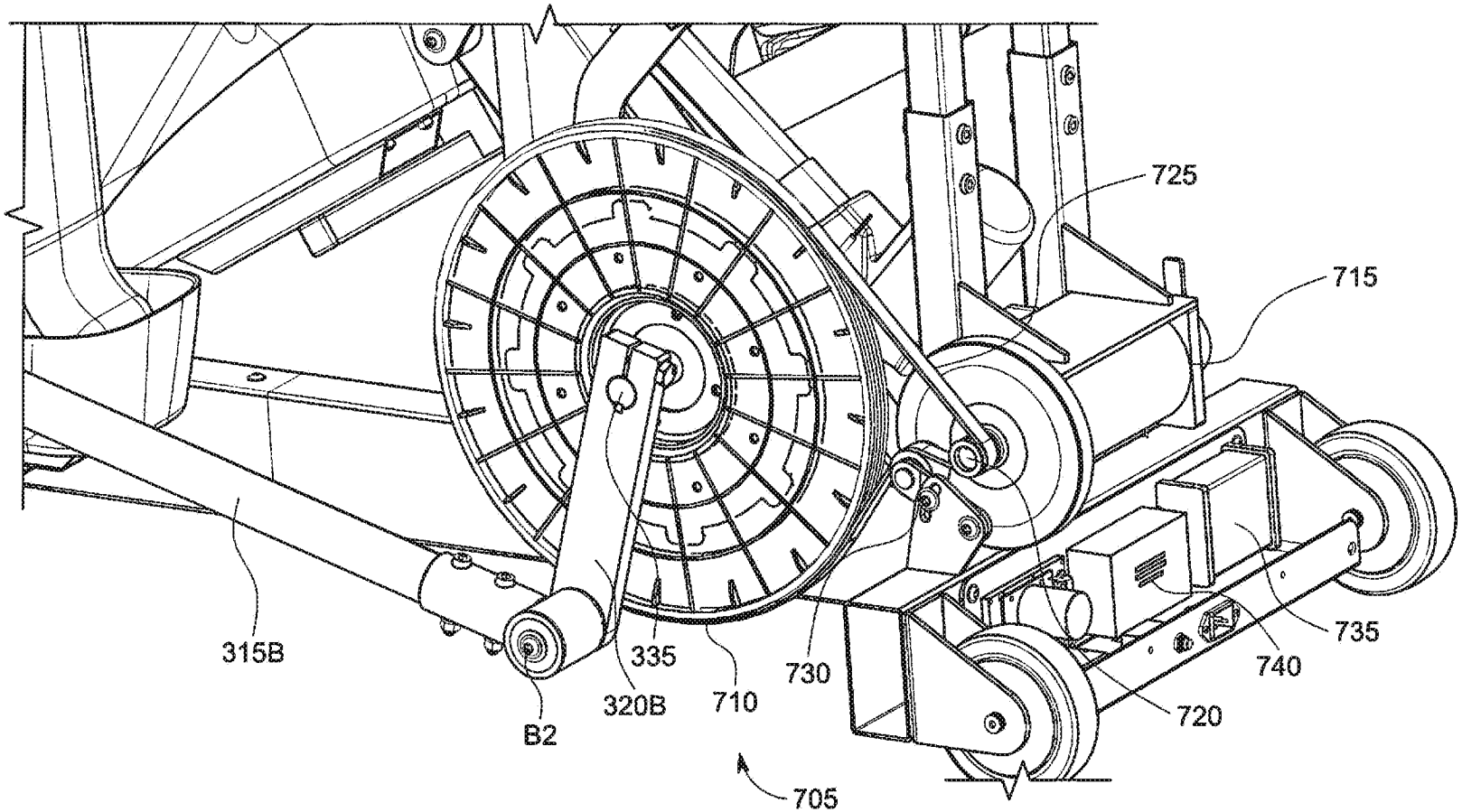
FIG. 8 depicts a back left side perspective view of an exemplary drive subsystem of a walk therapy station, showing detail of the left crank, motor, left-crank drive-wheel, and pretensioner.

FIG. 8 depicts a back left side perspective view of an exemplary drive subsystem of a walk therapy station, showing detail of the left crank, motor, left-crank drive-wheel, and pretensioner. Although not shown in FIGS. 7 and 8, the right side of the station 700 includes an SWM 405/*actuator* 330, and right linkages depicted in FIGS. 3A-3C, and 4. For example, the right side of station 700 may substantially resemble the right side of station 100. A motor drive system 705 includes the crankshaft 335. The crankshaft 335 is fixedly coupled to a left crank drive wheel 710. The crankshaft 335 is fixedly coupled to a left fifth linkage 320B. The left fifth linkage 320B is hingedly coupled to a left fourth linkage 315. The left crank drive wheel 710 is coupled to a motor shaft 720 of a (walk) motor 715 via a belt 725. The belt is tensioned by an adjustable pre-tensioning pulley 730.

The motor 715 drives the left fourth linkage 315B via the belt 725, the left crank drive wheel 710 and the left fifth linkage 320B. The left fourth linkage 315 in turn, moves the user's left foot in a walking pattern. This drive force from the motor 715 also drives the right side of the station 700, translating the drive force via the crankshaft 335. The crankshaft 335 exits the right side of the station 700, and drives intermediate linkage (not shown, but similar to intermediate linkage 325 shown in FIGS. 3A and 4) and associated right side linkages. Accordingly, the motor 715 drives both the left and right foot of the user in a walking pattern.

The motor 715 is powered by a power supply (e.g., FIG. 4, power supply 425). The motor 715 is controlled by a controller 740, which may also control other aspects of the station 700 (e.g., the actuators). Other items shown on the rear end of the station 700 may also make up parts of a walk motor controller that controls the motor 715. In various example, a walk therapy station may include at least one motor (e.g., one sit-to-stand motor that powers the actuator under the seat of the user, one stand-to-walk motor that powers the actuator coupled to the linkages at the rear end of the station, one gait resistance motor to create resistance against walking/gait motions (for the manual version of the station 100), and one gait assist motor to assist the user in performing walking/gait motions (walk motor for powered version 700). In some examples, a walk therapy station may include at least one sensor (e.g., a gait movement sensor (625) that collect different therapy data (speed, time walking, leg asymmetry, distance, time stamp), a sit-to-stand sensor in the sit-to-stand stand actuator/motor that indicates a sit-stand position, a stand-to-walk sensor in the stand-to-walk actuator/motor that indicates leg position, and a heart rate sensor (included with the handle bar 225)). Various sensors may be Hall effect sensors, for example. The motor controller 740 may collect therapy data such as motor speed and time of motor assist, for example, that may be communicated to the display 265. The display device 265 (e.g., tablet computer) may collect and saves data for the user. The display may have Bluetooth capabilities and may connect with other software applications or electronic hardware, such as blood pressure monitors and oxygen level monitors, for example. The display may connect to a person's computing device, such as an Android® or Apple® device, for example. The therapy data collected may be sent to the cloud and accessed by doctors and rehab professionals, as well as the user. The station may be used in conjunction with telehealth/telerehab using, for example, an add on camera and speakers. The controller 740 may interface with a user interface (e.g., 265) such that the user can control a walking speed of the station 700, make an emergency stop, and/or raise/lower the seat 225, for example.

Figure 9:
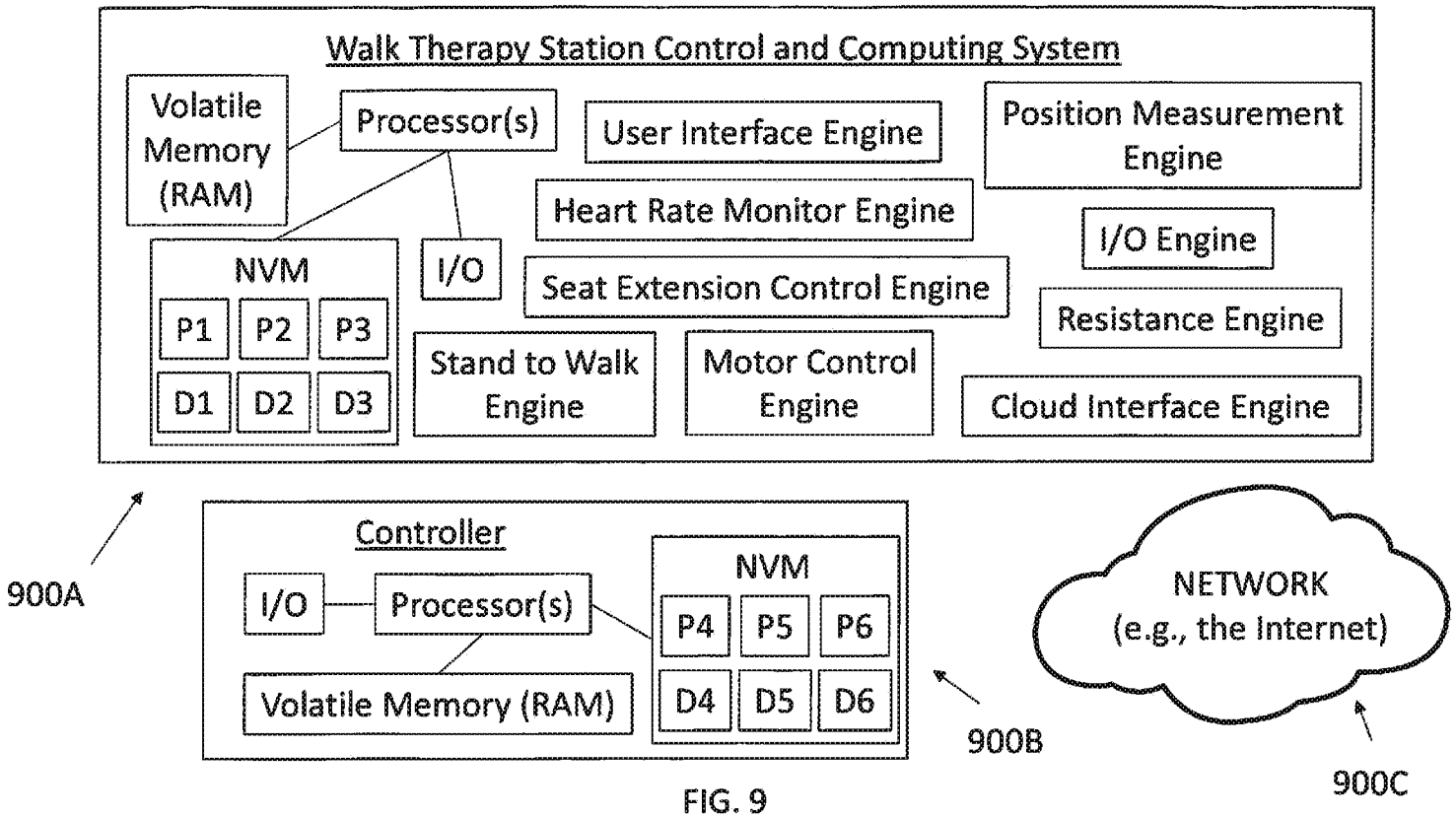
FIG. 9 depicts a block diagram view of a walk therapy station computing and control system.

FIG. 9 depicts a block diagram view of a walk therapy station computing and control system. A system includes a walk therapy station control and computing system 900A and at least one controller 900B. The system 900A includes processor(s) operably coupled to volatile memory (RAM), non-volatile memory (NVM), and input/output (I/O). In various examples, the system 900A may be implemented using a server. In some examples, the system 900A may be implemented using the user interface device 265 (e.g., a tablet/touch screen computer or other composing device) shown in FIGS. 2A and 2B. The NVM of the system 900A includes at least one set of program instructions (P1-P3), and at least one data block (D1-D3). The I/O of the system 900A is configured to exchange data with the at least one controller 900B. At least one of the programs P1-P3 of the system 900A may include instructions, that when executed by the processor(s), cause the system 900A to, for example, read/write data from/to the data blocks D1-D3 and/or transmit/receive data to/from the at least one controller 900B. The system 900A may interface with the at least one controller 900B to perform various actions, functions, or operations of the stations 100, 700, including, but not limited to, controlling the motor 715, controlling the actuators (seat extension system 110 actuator and stand to walk actuator 330/SWM 405), and/or measuring the position of the crank linkages 320A, 320B.

The system 900A may include various engines that power the various functions, operations, and aspects of the stations 100, 700. These engines may be program/software instructions (P1-P3) stored in the NVM of the system 900A, and may use the data stored in NVM. In various examples, the engines may be implemented using hardware or software of the system 900A. The system 900A may include the following engines:

User interface engine: perform various functions associated with the user interface, including reading user input, displaying visual indications on a display screen, and translating input into command or data to send to the at least one controller 900B.

Heart rate monitor engine: perform various functions associated with heart rate monitoring, including reading heart rate of a user via the heart rate monitors 255 and recording heart rate over time.

Seat extension control engine: perform various functions associated with the state of the seat 225 (sit to stand operations), including extending/retracting the seat 225 using the seat extension system 110.

Stand to walk engine: perform various functions associated with stand to walk operations, including measuring the state of the actuator 330, sending commands to the actuator 330 (or the actuator's controller) to transition the SWM 405 from standing to walking positions (or vice-versa), and measuring the power delivered to the actuator via the slip ring 420.

Motor control engine: perform various functions associated with the motor 715, including setting/measuring the speed of the motor, turning the motor on or off, setting a level of assistance (handicap) of the motor, and sending an emergency shutdown signal to the motor upon an emergency alert signal. The motor control engine may cooperate with the position measurement engine to determine the amount of power required to be delivered to the motor, for example.

Position measurement engine: perform various functions associated with measuring the position of the linkages, including receiving measurement data from the sensor 625, and determining the (angular) position of the crank linkages 320A, 320B based on the received measurement data from the sensor 625.

I/O engine: perform various functions associated with the I/O operations, including interfacing with the at least one controller 900B.

Cloud interface engine: perform various functions associated with interfacing with components in the "cloud," including sending/receiving data from cloud servers, and interfacing with remote physical therapy assistants or doctors. Examples of cloud storage interfaces are described with reference to FIG. 20 of U.S. Provisional Application Ser. No. 62/569,378, titled "Natural Assist Simulated Gait Therapy Adjustment System," filed by Alan Tholkes, et al., on Oct. 6, 2017.

Resistance engine: perform various functions associated with applying resistance to the gait motion of a user while using the station. For example, the resistance engine may receive (user) input for a resistance level, may track/log a level of resistance, and may control the level of resistance (e.g., via magnets on an eddy current brake).

The at least one controller 900B includes processor(s) operably coupled to volatile memory (RAM), non-volatile memory (NVM), and input/output (I/O). In some examples, each controller 900B may have only a single memory (either RAM or NVM). The NVM of the controller 900B includes at least one set of program instructions (P4-P6), and at least one data block (D4-D6). At least one of the programs P4-P6 of the controller 900B may include instructions, that when executed by the processor(s), cause the controller 900B to, among other things, read/write data from/to the data blocks D4-D6 and/or transmit/receive data to/from the system 900A.

Each controller 900B may be configured to perform specialized operations to control various components of the stations 100, 700. For example, the motor 715 may have its own controller 900B configured to control various aspect (speed, power, on/off) of the motor 715. In some embodiments, the actuator 330/SWM 405 may have its own controller 900B configured to control various aspect (mode, position, power, actuation speed) or the actuator 330. In various implementations, the actuator of the seat extension system 110 may have its own controller 900B configured to control various aspects (mode, position, power, actuation speed) of the seat extension system 110. The stations 100, 700 may include various interconnections (e.g., wiring, antennas) that may interconnect the various parts of the stations to provide for data communication and/or electrical power, for example. In some embodiments, each motor controller may be combined into a motors controller. The motors controller may have sensors connected to the it and may be electronically designed to interface with a display device.

Although various embodiments have been described with reference to the Figures, other embodiments are possible. For example, various parts, components, features, or aspects disclosed in other patents and patent applications may be combined with, included with, or substituted for, various parts, components, features, or aspects of the devices, systems, or processed disclosed herein. The following is a list of other patents and patent applications which may be used in conjunction with the devices, systems, or processed disclosed herein, all of which are herein incorporated by reference: U.S. Provisional Application Ser. No. 61/915,834, titled "Natural-Gait Therapy Device," filed by Alan Tholkes, et al., on Dec. 13, 2013; U.S. Nonprovisional application Ser. No. 14/529,568, titled "Multi-Modal Gait-Based Non-Invasive Therapy Platform," filed by Alan Tholkes, et al., on Oct. 31, 2014; U.S. Provisional Application Ser. No. 62/374,383, titled "Natural Assist Simulated Gait Therapy Adjustment System," filed by Alan Tholkes, et al., on Aug. 12, 2016; U.S. PCT Application Serial No. PCT/US17/46788, titled "Natural Assist Simulated Gait Therapy Adjustment System," filed by Alan Tholkes, et al., on Aug. 14, 2017; U.S. Provisional Application Ser. No. 62/569,378, titled "Natural Assist Simulated Gait Therapy Adjustment System," filed by Alan Tholkes, et al., on Oct. 6, 2017.

In various examples, the words "pivot" or "pivotably" may be used interchangeably with the words "hinge" or "hingedly." In various implementations, the phrase "substantially circular" may mean an ellipse with an eccentricity value of about 0, 0.1, 0.2, 0.3, 0.4, or about 0.5. In some implementations, the phrase "lateral" may refer to a lateral axis passing between the right and left sides of the station, while the phrase "longitudinal" may refer to a longitudinal axis passing between the front and back ends of the station.

Exemplary dimensions for the various linkages of the station 100 may be as follows: the first linkage 300 may have a length of about 16", the second linkage 305 may have a length of about 30", the third linkage 310 may have a length of about 17", the fourth linkage 315 may have a length of about 32", the fifth linkage 320 may have a length of about 7", and the intermediate linkage 325 may have a length of about 6". These lengths may be critical to the achieve the natural gait function of the stations 100, 700, such that a user performs an assisted walking motion that advantageously mimics the natural gait of the user. Put another way, the lengths listed above of each linkage may be optimized values that provide for a very natural and accurate gait motion of a user 102, thus providing the user with a very therapeutic and productive physical training session. It may be understood that these lengths may be adjusted by about 0.1", 0.5", 1", 2", or about 5" or more and still retain the benefits of an optimized, natural gait/walking motion.

Some aspects of embodiments may be implemented as a computer system. For example, various implementations may include digital and/or analog circuitry, computer hardware, firmware, software, or combinations thereof. Apparatus elements can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Some embodiments may be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random-access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from a source to a receiver over a dedicated physical link (e.g., fiber optic link, infrared link, ultrasonic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, FireWire, ATA/IDE, RS-232, RS-422, RS-485, 802.11 a/b/g/n, Wi-Fi, WiFi-Direct, Li-Fi, BlueTooth, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

In various embodiments, a computer system may include non-transitory memory. The memory may be connected to the one or more processors may be configured for encoding data and computer readable instructions, including processor executable program instructions. The data and computer readable instructions may be accessible to the one or more processors. The processor executable program instructions, when executed by the one or more processors, may cause the one or more processors to perform various operations.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A walking therapy apparatus comprising:

a frame; and, a first knee and foot support system comprising:

a first linkage pivotably coupled at a proximal end to the frame;

a second linkage pivotably coupled at a proximal end to the frame;

a third linkage pivotably coupled at a proximal end to a distal end of the first linkage;

a fourth linkage pivotably coupled at a proximal end to a distal end of the second linkage, the fourth linkage being pivotably coupled at a point along a length of the fourth linkage to a point along a length of the third linkage; and, a fifth linkage pivotably coupled at a proximal end to a distal end of the fourth linkage, the fifth linkage being mechanically coupled to a fixed rotational axis, such that in an operational mode, the proximal end of the fifth linkage travels in a first substantially circular path having a first center point aligned with the fixed rotational axis; and, an actuator operably coupled to the fifth linkage such that in a first mode, the actuator is engaged to place the proximal end of the fifth linkage in a first position along the first substantially circular path, and in a second mode, the actuator is disengaged to place the proximal end of the fifth linkage in a second position along the first substantially circular path that is different than the first position.

2. The walking therapy apparatus of claim 1, wherein the first position and the second position are substantially 180° out of phase with one another.

3. The walking therapy apparatus of claim 2, further comprising an intermediate linkage pivotably coupled at a proximal end to a distal end of the fifth linkage and coupled at a distal end at the fixed rotational axis to facilitate the mechanical coupling between the fifth linkage and the fixed rotational axis.

4. The walking therapy apparatus of claim 3, wherein in the first mode, an angle between the fifth linkage and the intermediate linkage is at a first angular value, and in the second mode, the angle between the fifth linkage and the intermediate linkage is at a second angular value different from the first angular value.

5. The walking therapy apparatus of claim 1, further comprising a slip ring operably coupled to the actuator and configured to deliver operating power to the actuator.

6. The walking therapy apparatus of claim 1, further comprising a foot pedal mechanically coupled to a distal end of the third linkage.

7. The walking therapy apparatus of claim 1, further comprising a knee pad mechanically coupled to at least one of the distal end of the first linkage and the proximal end of the third linkage.

8. The walking therapy apparatus of claim 1, further comprising a sensor configured to measure an indication of angular position of a distal end of the fourth linkage relative to the fixed rotational axis.

9. The walking therapy apparatus of claim 1, further comprising:

a second knee and foot support system comprising:

a sixth linkage pivotably coupled at a proximal end to the frame;

a seventh linkage pivotably coupled at a proximal end to the frame;

an eighth linkage pivotably coupled at a proximal end to a distal end of the sixth linkage;

a ninth linkage pivotably coupled at a proximal end to a distal end of the seventh linkage, the ninth linkage being pivotably coupled at a point along a length of the ninth linkage to a point along a length of the eighth linkage; and, a tenth linkage pivotably coupled at a proximal end to a distal end of the ninth linkage, the tenth linkage being mechanically coupled to the fixed rotational axis, such that in the operational mode, the proximal end of the tenth linkage travels in a second substantially circular path having a second center point aligned with the fixed rotational axis.

10. A walking therapy apparatus comprising:

a frame; and, a first knee and foot support system comprising:

a first linkage pivotably coupled at a proximal end to the frame;

a second linkage pivotably coupled at a proximal end to the frame;

a third linkage pivotably coupled at a proximal end to a distal end of the first linkage;

a fourth linkage pivotably coupled at a proximal end to a distal end of the second linkage, the fourth linkage being pivotably coupled at a point along a length of the fourth linkage to a point along a length of the third linkage;

a fifth linkage pivotably coupled at a proximal end to a distal end of the fourth linkage, the fifth linkage being mechanically coupled to a fixed rotational axis, such that in an operational mode, the proximal end of the fifth linkage travels in a first substantially circular path having a first center point aligned with the fixed rotational axis; and, an actuator operably coupled to the fifth linkage such that in a first mode, the actuator is engaged to place the proximal end of the fifth linkage in a first position along the first substantially circular path, and in a second mode, the actuator is disengaged to place the proximal end of the fifth linkage in a second position along the first substantially circular path that is different than the first position, wherein the first position and the second position are substantially 180° out of phase with one another.

11. The walking therapy apparatus of claim 10, further comprising:

a second knee and foot support system comprising:

a sixth linkage pivotably coupled at a proximal end to the frame;

a seventh linkage pivotably coupled at a proximal end to the frame;

an eighth linkage pivotably coupled at a proximal end to a distal end of the sixth linkage;

a ninth linkage pivotably coupled at a proximal end to a distal end of the seventh linkage, the ninth linkage being pivotably coupled at a point along a length of the ninth linkage to a point along a length of the eighth linkage; and, a tenth linkage pivotably coupled at a proximal end to a distal end of the ninth linkage, the tenth linkage being mechanically coupled to the fixed rotational axis, such that in the operational mode, the proximal end of the tenth linkage travels in second substantially circular path having a second center point aligned with the fixed rotational axis.

12. The walking therapy apparatus of claim 10, wherein:

in the first mode, the proximal end of the fifth linkage is laterally aligned with a proximal end of the tenth linkage, and, in the second mode the proximal end of the fifth linkage is arranged on an opposite side of the fixed rotational axis relative to the proximal end of the tenth linkage, such that the proximal end of the fifth linkage is 180° out of phase with the proximal end of the tenth linkage along the first and second substantially circular paths, wherein the first and second substantially circular paths are laterally aligned with one another.

13. The walking therapy apparatus of claim 10, further comprising a slip ring operably coupled to the actuator and configured to deliver operating power to the actuator.

14. The walking therapy apparatus of claim 10, further comprising a foot pedal mechanically coupled to a distal end of the third linkage.

15. The walking therapy apparatus of claim 10, further comprising a knee pad mechanically coupled to at least one of the distal end of the first linkage and the proximal end of the third linkage.

16. A walking therapy apparatus comprising:

a frame; and, a first knee and foot support system comprising:

a first linkage pivotably coupled at a proximal end to the frame;

a second linkage pivotably coupled at a proximal end to the frame;

a third linkage pivotably coupled at a proximal end to a distal end of the first linkage;

a fourth linkage pivotably coupled at a proximal end to a distal end of the second linkage, the fourth linkage being pivotably coupled at a point along a length of the fourth linkage to a point along a length of the third linkage; and, a fifth linkage pivotably coupled at a proximal end to a distal end of the fourth linkage, the fifth linkage being mechanically coupled to a fixed rotational axis, such that in an operational mode, the proximal end of the fifth linkage travels in a first substantially circular path having a first center point aligned with the fixed rotational axis, and, means for transitioning the fifth linkage between a first mode and a second mode, wherein in the first mode, the proximal end of the fifth linkage is in a first position along the first substantially circular path, and in the second mode, the proximal end of the fifth linkage in a second position along the first substantially circular path that is different than the first position.

17. The walking therapy apparatus of claim 16, wherein the first position and the second position are substantially 180° out of phase with one another.

18. The walking therapy apparatus of claim 16, further comprising an intermediate linkage pivotably coupled at a proximal end to a distal end of the fifth linkage and coupled at a distal end to the fixed rotational axis to facilitate the mechanical coupling between the fifth linkage and the fixed rotational axis.

19. The walking therapy apparatus of claim 16, further comprising:

a second knee and foot support system comprising:

a sixth linkage pivotably coupled at a proximal end to the frame;

a seventh linkage pivotably coupled at a proximal end to the frame;

an eighth linkage pivotably coupled at a proximal end to a distal end of the sixth linkage;

a ninth linkage pivotably coupled at a proximal end to a distal end of the seventh linkage, the ninth linkage being pivotably coupled at a point along a length of the ninth linkage to a point along a length of the eighth linkage; and, a tenth linkage pivotably coupled at a proximal end to a distal end of the ninth linkage, the tenth linkage being mechanically coupled to the fixed rotational axis, such that in the operational mode, the proximal end of the tenth linkage travels in a second substantially circular path having a second center point aligned with the fixed rotational axis.

* * * * *